United States Patent [19]

Almog

[11] Patent Number: 5,000,500

[45] Date of Patent: Mar. 19, 1991

[54] DISPOSABLE PLASTIC BAGS

[76] Inventor: Ehud Almog, 6 Golie Kenia St., Tel Aviv, Israel

[21] Appl. No.: 371,109

[22] Filed: Jun. 26, 1989

[30] Foreign Application Priority Data

Jul. 17, 1988 [IL] Israel ..... 87142

[51] Int. Cl.[5] ..... A01K 29/00; A47L 13/52

[52] U.S. Cl. ..... 294/1.3; 15/257.1

[58] Field of Search ..... 294/1.3, 25; 15/257.1, 15/257.6, 257.9; 150/150, 900; 383/33, 34

[56] References Cited

U.S. PATENT DOCUMENTS

| | | | |
|---|---|---|---|
| 3,160,186 | 12/1964 | Conley | 150/150 X |
| 3,272,248 | 9/1966 | O'Farrell | 150/150 X |
| 3,767,247 | 10/1973 | Wetzler | 294/1.3 |
| 3,971,503 | 7/1976 | Allan et al. | 15/257.1 X |
| 3,978,540 | 9/1976 | Peck et al. | 294/1.3 |
| 4,148,510 | 4/1979 | Brack et al. | 294/1.3 |
| 4,431,222 | 2/1984 | Rotella | 294/1.3 |

*Primary Examiner*—Margaret A. Focarino
*Assistant Examiner*—Dean J. Kramer
*Attorney, Agent, or Firm*—Leonard Bloom

[57] ABSTRACT

A plastic bag for the collection of dirt, particularly dogs' excrement, off the ground, comprising a flat, envelope-like portion made of a yieldable sheet material with an open rim defining opposite, substantially straight lips extending one next to the other. Each lip is provided with a strip of a semi-rigid, bendable material. The respective ends of the strips are connected to each other to form a pair of hinges, such that the strips are flexed one away from the other by a pushing force applied thereagainst, the closed one against the other by a pulling force applied to the hinges.

6 Claims, 4 Drawing Sheets

DISPOSABLE PLASTIC BAGS

BACKGROUND OF THE INVENTION

The present invention relates to disposable refuse collecting bags, in particular for removing dogs' excrement or other messy dirt off the ground.

As already prescribed by the municipal authorities of many cities in the world, owners of dogs are responsible for collecting their dogs' excrements from pavements, boulevards, etc. or be subject to payment of a substantial fine.

The enforcement of these regulations have induced a number of means for assisting dog owners in this unpleasant task, the major object thereof being to enable the performance of the operation with as little physical contact as possible with the objects to be removed.

Known implements for the purpose in question were based on shovel-like bags made, as a rule, of relatively rigid sheet material such as cardboard, and frequently imposed the use of another, auxiliary element that had to be used to complete the dirt collection.

The present invention aims to provide a bag for the collection of messy dirt off a planar surface by a more or less conventional polyethylene bag, without the use of any additional means.

It is a further object of the invention to provide a conventional plastic bag with such means as to allow the removal of dirt as aforesaid, which includes integral scraping means so that the surface is left as clean as possible.

SUMMARY OF THE INVENTION

There is thus provided, according to the present invention, a bag for the collection of dirt, particularly dogs' excrement, off the ground, comprising a flat, envelope-like portion made of a yieldable sheet material with an open rim defining opposite, substantially straight lips extending one next to the other. Each lip is provided with a strip of a semi-rigid, bendable material. The respective ends of the strips are connected to each other to form a pair of hinges, such that the strips are flexed one away from the other by a pushing force applied thereagainst, and closed one against the other by a pulling force applied to the hinges.

The sheet material of the bag, as well as the strips are preferably made of plastics and may be integrally formed.

The hinge connections of the strips may be integrally formed with the strips and may be flattened into a form of gripping tabs assisting in the manipulation of the bag.

Fastening means may be provided for attaching one tab to the other after collecting the dirt.

In addition, a pair of apron-like sections may be provided depending from the seams between the strips and the body portion of the bags.

BRIEF DESCRIPTION OF THE DRAWINGS

These and additional features and advantages of the invention will become more clearly understood in the light of the ensuing description of the few preferred embodiments of the invention, given, by way of example only, with reference to the accompanying drawings, wherein.

DETAILED DESCRIPTION OF THE PREFERRED EMBODIMENTS

Figure 1:
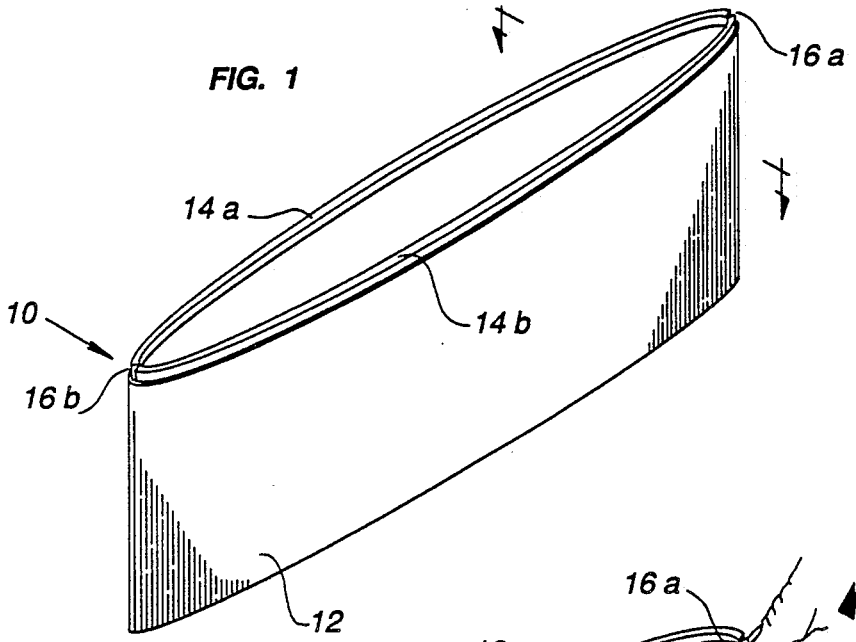
FIG. 1 is a general, three-dimensional view of the bag provided according to one embodiment of the invention.
Figure 2:
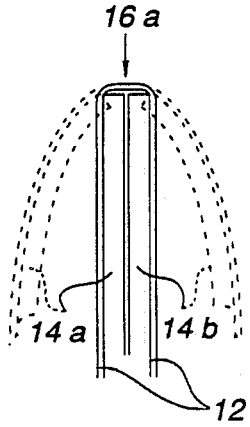
FIG. 2 shows, on an enlarged scale, a top corner portion as viewed along-line II—II of FIG. 1.

The bag, generally denoted 10 in FIG. 1, comprises a rectangular, envelope-like main portion 12 made of thin, paper-like plastic sheet such as polyethylene. A pair of elongated plastic strips 14*a* and 14*b* are seamed, e.g. by heat or ultra-sonic welding to the open rim of the bag, as shown, joined or hinged to each other at their ends marked 16*a* and 16*b*, being surrounded by the sheet material proper at the respective sides of the bag portion 12, as more clearly shown in FIG. 2. Alternatively, the strips of the bag may be integrally manufactured by any known technique.

Figure 3:
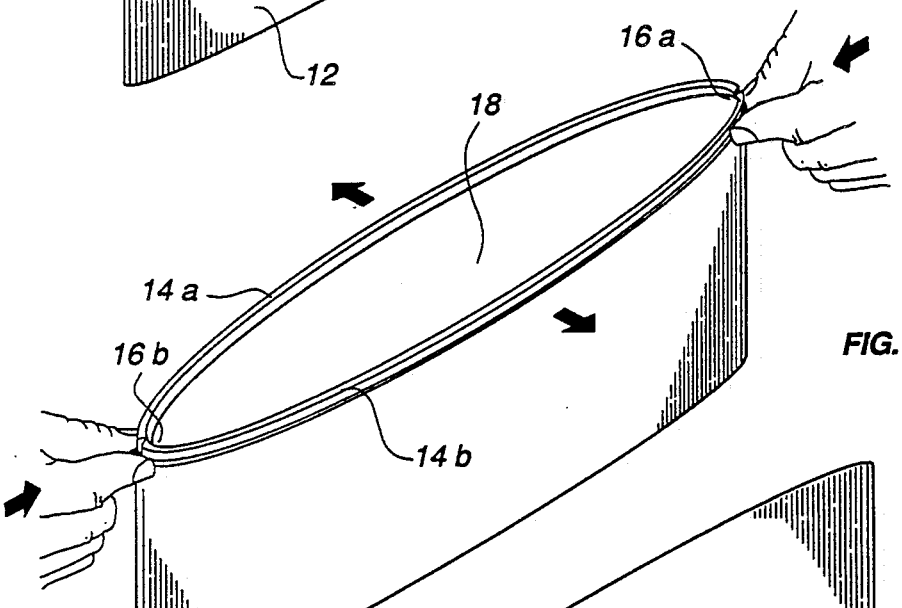
FIG. 3 illustrates the stage of opening the bag in preparation for collecting of dirt.

The strips 14 thus constitute a frame defining the opening of the bag. The material of the strips 14 is semi-rigid, somewhat flexible, so that when the joints 16 are forced to approach one in the direction of the other e.g. by pushing against the two corner joints or hinges, as illustrated in FIG. 3, the strips are flexed one away from the other to provide an opening 18 of the bag—see position shown in broken lines in FIG. 2.

In order to assure the flexing away of the strips—rather than bending together in one or the other direction—it is advantageous to apply a certain initial strain to the strips acting in the desired directions, or to provide means such as described in greater detail in connection with FIG. 10 below.

Figure 4:
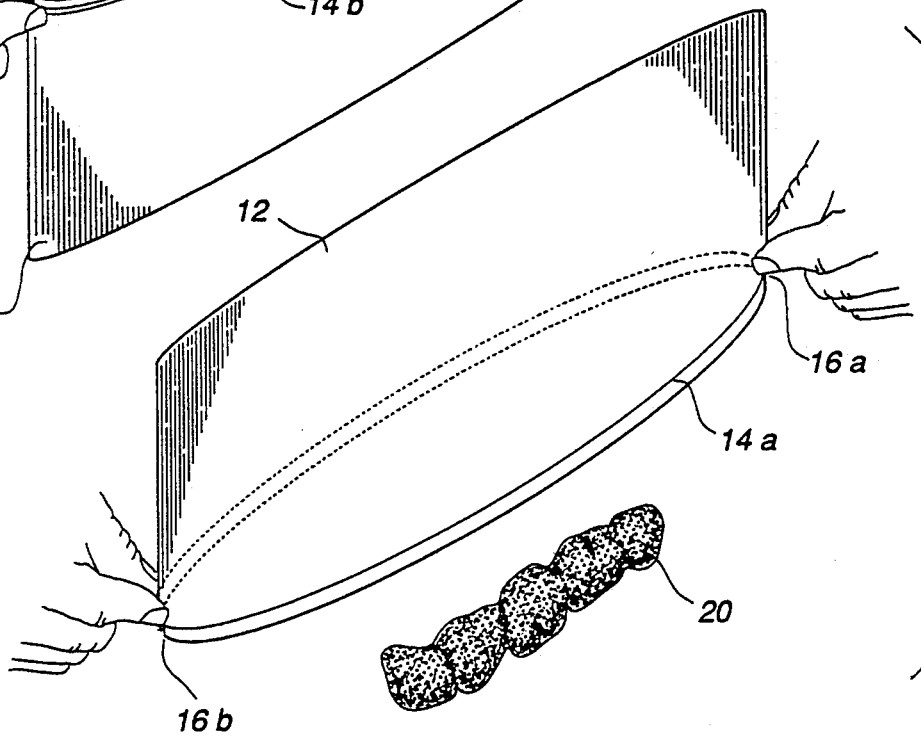
FIG. 4 shows an intermediate stage of removing a piece of dirt after the opening of the bag.
Figure 5:
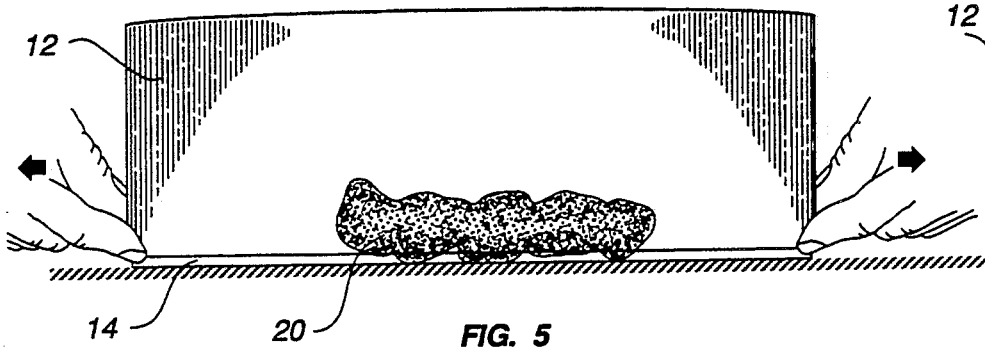
FIG. 5 shows the bag closing on the piece of dirt.
Figure 6:
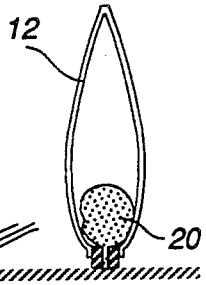
FIG. 6 is a side-view of FIG. 5.
Figure 7:
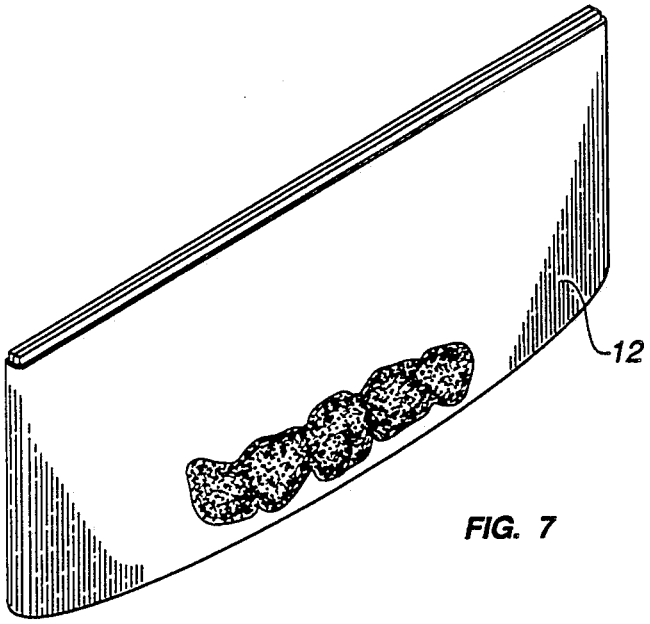
FIG. 7 shows the bag with the dirt stored therein.

Once partly open, the bag will be turned upsidedown while still held by both hands at the joint sections 16 and placed over a (soft) dirt piece 20 to be picked up, as illustrated in FIG. 4. When the strips lie flat on the surface around the dirt piece 20, the pushing force of the hands is changed into a pulling operation. This will result in the approach of the strips one towards the other, at a force proportional to the sidewise pulling force. The strips will become wedged under the dirt piece 20 and compress it upwards over the strips and into the bag as clearly shown in FIGS. 5 and 6. Still pulling outwards on the strips as before, the bag is raised and turned upsidedown causing the dirt piece to fall freely to the bottom of the bag as shown in FIG. 7. The bag is then discarded.

Figure 8:
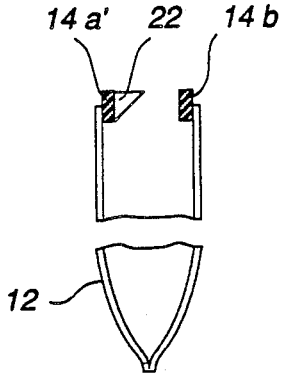
FIG. 8 illustrates a modified profile of one of the bag's strips;.

For attaining a cleaner pick-up operation, it is advantageous to provide at least one of the strips, denoted 14a' in FIG. 8, with a knife-edge rib 22 extending at least along a part of the strip which, when applied against the counterpart strip 14b, will assure a better scraping of the messy dirt piece.

Figure 9:
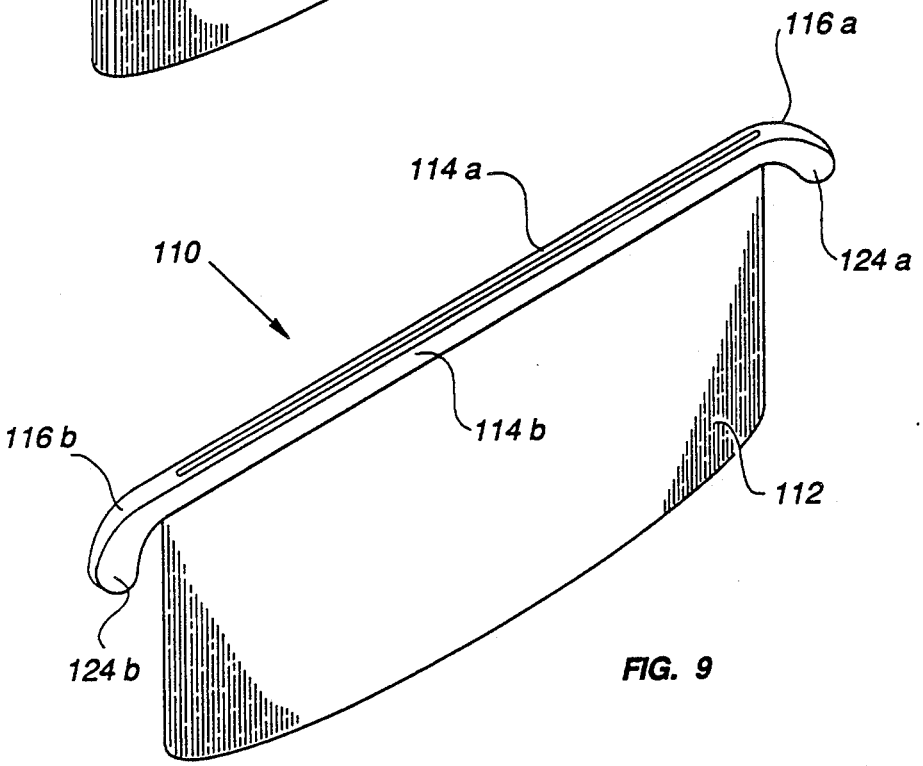
FIG. 9 is a further modified embodiment of the invention.

In FIG. 9, the strips 114a and 114b are integrally formed with each other including their junction or joints 116a and 116b at the two extreme ends thereof. Still further, a pair of gripping tabs 124a and 124b may be formed by flattening the free ends of the strips assembly or frame, thus facilitating the holding and manipulating of the bag during use.

Figure 10:
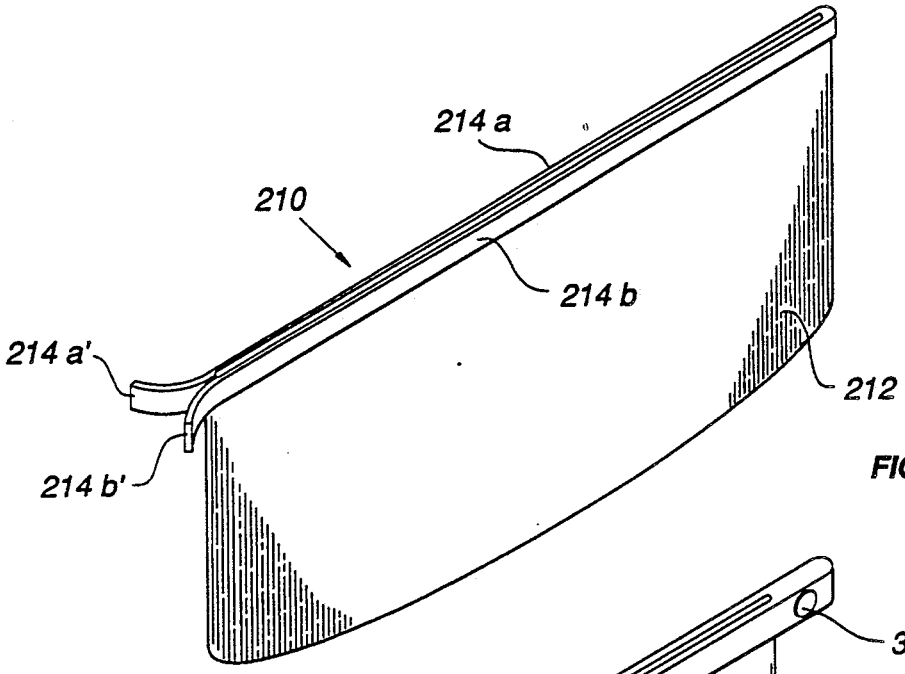
FIG. 10 is a still further modified embodiment of the bag according to the present invention.

In FIG. 10 there are shown means in the form of a pair of lugs 214a' and 214b' integrally formed with their respective strips 214a and 214b at least at one end of the bag 210. By first pressing the two lugs one against the other an initial bent-open position of the strips is assured, further enhanced by pushing one end of the strips against the other in the above described manner.

Figure 11:
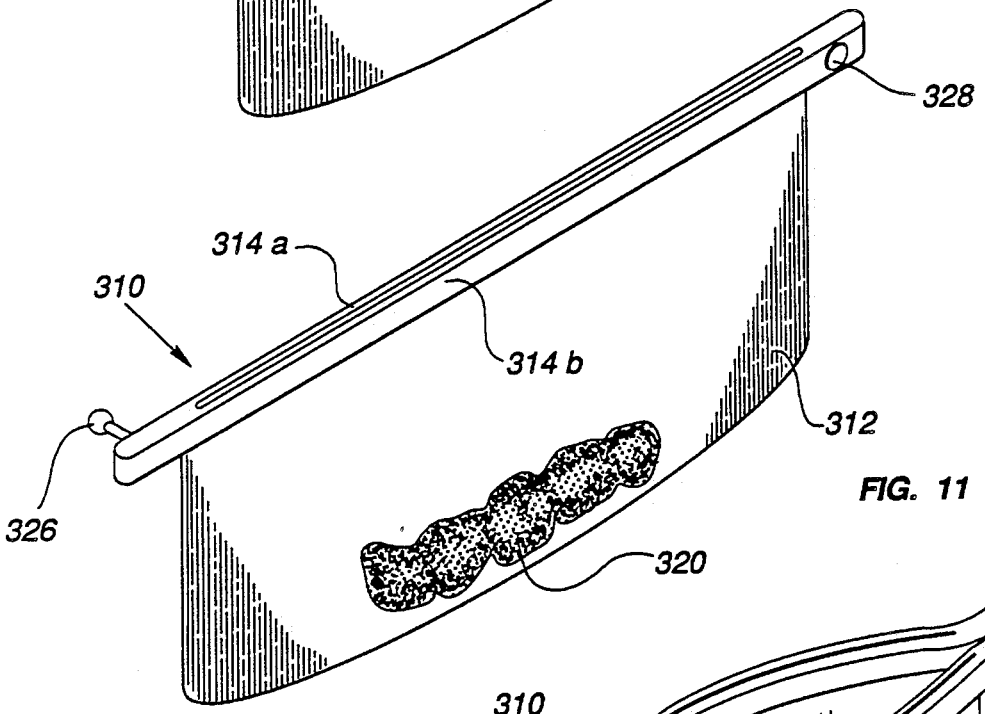
FIG. 11 shows a bag with fastening means associated with the side tabs thereof.
Figure 12:
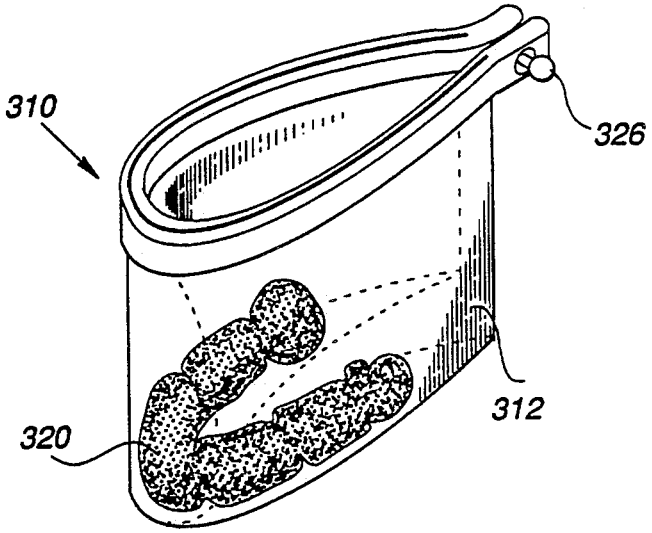
FIG. 12 shows the bag of FIG. 11 in a folded, ready to discard state.

The bag 310 of FIGS. 11 and 12 is further improved by providing pin-and-socket fastening means for holding the filled bag in a neater and more compact folded form, before discarding same, keeping in mind that it may take some time for the dog owner to walk to a nearby refuse basket. Hence, at one end of one of the strips 314 there is provided a headed pin 326 whereas at the other end a suitable throughgoing hole 328 is formed so that in the folded position shown in FIG. 12, the pin 326 is snapped into the hole 328 to hold the bag in a fixed, folded position.

Figure 13:
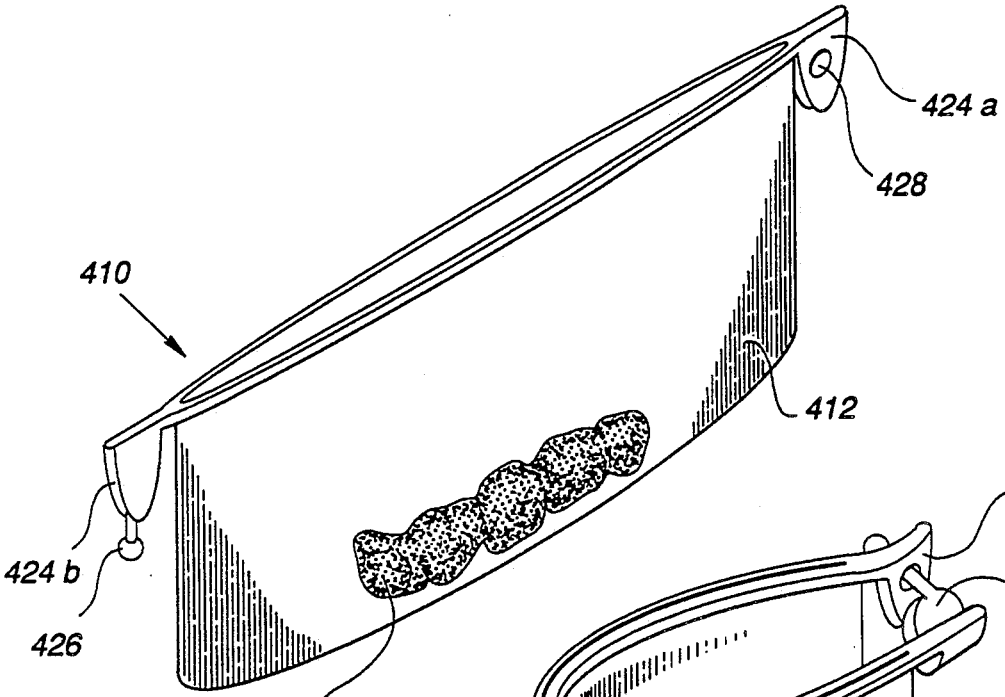
FIG. 13 is an alternative embodiment of the bag of FIG. 11.
Figure 14:
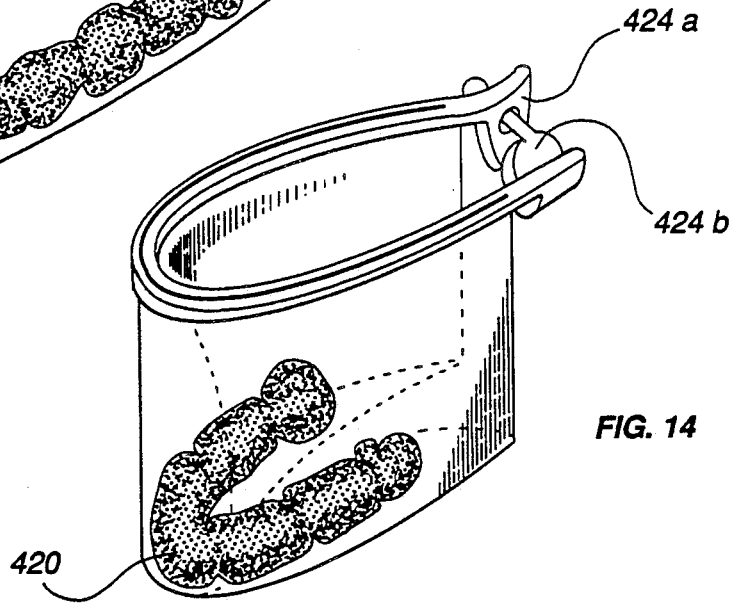
FIG. 14 shows the bag of FIG. 13 in its folded state.

An alternative self-locking arrangement is shown in FIGS. 13 and 14, where one of the tabs, 424b, is shaped to include a semi-circular extension 426, and the other tab, 424a is formed with an opening 428. The tabs are fastened to each other in the manner illustrated in FIG. 14.

Figure 15:
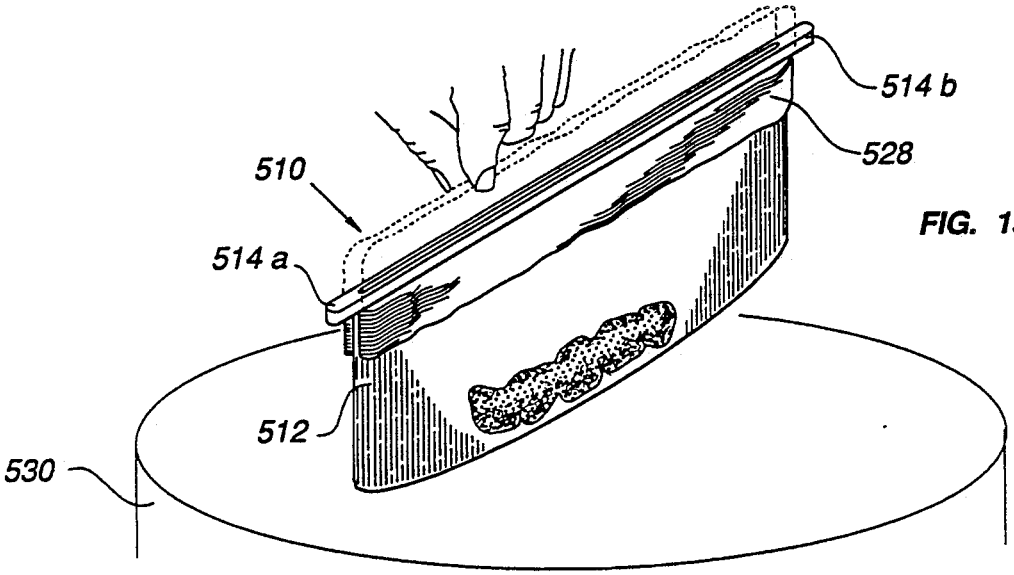
FIG. 15 shows the bag with alternative closing and holding means.

In FIG. 15 an additional improved form is shown, residing by the provision of, at one or both sides of the bag 510, a pair of apron-like extensions 528 depending from the seams between the main bag portion 512 and the respective strips 514a and/or 514b. As shown in broken lines in FIG. 15 the apron sections are used to hold the bag in a closed position without contaminating the hand while carrying the bag away to a refuse basket 530.

It has thus been established that the bag designed according to the present invention provides a most simple and convenient solution to the messy problem at hand. The mass production of the bags according to any of the preceding embodiments is well within the standard plastic bags manufacturing technology and therefore attainable at a very low cost.

Those skilled in the art will readily appreciate that various changes, modifications and variations of the exemplified embodiments of the invention may be applied without departing from the scope thereof as defined in and by the appended claims.

What is claimed is:

1. A bag for collecting dirt, particularly dogs' excrement off the ground, comprising an envelope-like portion made of yieldable sheet material with an open rim defining opposite, substantially straight lips extending one along the other, characterised in that each lip is provided with a strip of a semi-rigid, bendable material, and the respective ends of the strips are joined to each other to form a pair of hinges, such that the strips are flexed one away from the other by a pushing force applied thereagainst, and closed one against the other by a pulling force applied to said hinges;

wherein the said sheet material and the strips are made of plastics;

wherein the said strips are flattened at their ends to form a pair of gripping tabs; and wherein the tabs are provided with means for fastening one tab to the other.

2. The bag of claim 1 wherein one tab is provided with a pin and the other with a snap-in socket.

3. A bag for collecting dirt, particularly dogs' excrement off the ground, comprising an envelope-like portion made of a yieldable sheet material with an open rim defining opposite, substantially straight lips extending one along the other, characterised in that each lip is provided with a strip of a semi-rigid, bendable material, and the respective ends of the strips are joined to each other to form a pair of hinges, such that the strips are flexed one away from the other by a pushing force applied thereagainst, and closed one against the other by a pulling force applied to said hinges;

wherein the said sheet material and the strips are made of plastics; and wherein at least one of the strips hinges is formed with a pair of lugs extending one away from the other for forcing open the said strips when closing the lugs one against the other.

4. A bag for collecting dirt, particularly dogs' excrement off the ground, comprising an envelope-like portion lying in a plane, the envelope-like portion being made of a yieldable sheet material with an open rim defining opposite, substantially straight lips extending one along the other, each lip being provided with a strip of a semi-rigid, bendable material, and the respective ends of the strips are joined to each other to form a pair of hinges, each of the hinges being extended by a flattened tab lying in the plane of the bag so that the strips may become flexed one away from the other by a pushing force, and closed one against the other by a pulling force applied to said tabs, wherein the said sheet, strips and the tabs are made of plastics, wherein the strips and their hinge joints, and the tabs, are integrally formed of plastic material, seamed to the said lips, and wherein the tabs are provided with means for fastening one tab to the other.

5. The bag of claim 4 wherein one tab is provided with a pin and the other with a snap-in socket.

6. A bag held in two hands by a user for collecting dirt, particularly dogs' excrement off the ground, comprising an envelope-like portion made of yieldable sheet material with an open rim defining opposite, substantially straight lips extending one along the other, characterized in that each lip is provided with a strip of a semi-rigid, bendable material, and the respective ends of the strips are joined to each other to form a pair of hinges, a separate flat gripping tab attached to each respective hinge, each tab extending outwardly from the respective hinge, such that when the gripping tabs are grasped with the user's two hands, the strips are flexed one away from the other by a pushing force applied thereagainst, whereby the bag is opened to receive the dirt, and when the bag is inverted and the strips are closed one against the other by a pulling force applied to said hinges by both hands, the dirt is enclosed in the bag.

* * * * *